US008764974B2

(12) United States Patent
Cross et al.

(10) Patent No.: US 8,764,974 B2
(45) Date of Patent: Jul. 1, 2014

(54) PROCESSING AIDS TO IMPROVE THE BITUMEN RECOVERY AND FROTH QUALITY IN OIL SANDS EXTRACTION PROCESSES

(75) Inventors: Kimberly Jantunen Cross, Hoffman Estates, IL (US); Anoop Chengara, Hoffman Estates, IL (US); Anthony G. Sommese, Aurora, IL (US); Edward Maharaih, Calgary (CA)

(73) Assignee: Nalco Company, Naperville, IL (US)

( * ) Notice: Subject to any disclaimer, the term of this patent is extended or adjusted under 35 U.S.C. 154(b) by 620 days.

(21) Appl. No.: 12/762,004

(22) Filed: Apr. 16, 2010

(65) Prior Publication Data

US 2011/0253599 A1 Oct. 20, 2011

(51) Int. Cl.
*C10G 1/04* (2006.01)

(52) U.S. Cl.
USPC ..... 208/390; 208/391; 210/638

(58) Field of Classification Search
USPC ..... 208/390
See application file for complete search history.

(56) References Cited

U.S. PATENT DOCUMENTS

| | | | | |
|---|---|---|---|---|
| 3,330,757 | A | 7/1967 | Bichard | |
| 3,847,789 | A | 11/1974 | Cymbalisty | |
| 4,338,185 | A | 7/1982 | Noelle | |
| 5,051,487 | A * | 9/1991 | Bhattacharyya et al. | 526/287 |
| 5,750,034 | A | 5/1998 | Wong Shing et al. | |
| 6,042,732 | A | 3/2000 | Jankowski et al. | |
| 6,083,404 | A | 7/2000 | Sommese et al. | |
| 6,486,216 | B1 | 11/2002 | Keiser et al. | |
| 2005/0194292 | A1 * | 9/2005 | Beetge et al. | 208/391 |
| 2005/0194323 | A1 * | 9/2005 | Ruth et al. | 210/723 |
| 2005/0234136 | A1 | 10/2005 | Holland et al. | |
| 2007/0090025 | A1 * | 4/2007 | Strand | 208/391 |
| 2008/0060999 | A1 * | 3/2008 | Musale et al. | 210/636 |
| 2008/0099380 | A1 | 5/2008 | Lahaie et al. | |
| 2008/0173060 | A1 * | 7/2008 | Cymbalisty et al. | 72/369 |
| 2009/0127205 | A1 | 5/2009 | Sikes et al. | |
| 2010/0068519 | A1 | 3/2010 | Holland et al. | |
| 2010/0074974 | A1 | 3/2010 | Holland et al. | |
| 2011/0017676 | A1 | 1/2011 | Franks et al. | |

FOREIGN PATENT DOCUMENTS

| | | | |
|---|---|---|---|
| AU | WO2009089570 | A1 | 7/2009 |
| CA | 289058 | A | 4/1929 |

OTHER PUBLICATIONS

Li et al, "Novel Polymer Aids for Low-Grade Oil Sand Ore Processing," Canadian Journal of Chemical Engineering, vol. 86, 2008, pp. 168-176.

* cited by examiner

*Primary Examiner* — Randy Boyer
*Assistant Examiner* — Juan Valencia
(74) *Attorney, Agent, or Firm* — Edward O. Yonter

(57) ABSTRACT

Disclosed and claimed is a method for improving the froth quality and bitumen recovery in primary bitumen extraction processes by coagulant addition in the underwash feed water. Preferred coagulants are cationic or amphoteric polymers. Coagulant addition in the underwash feed water reduces the solids content reporting to the primary bitumen froth in a primary separation vessel (PSC). This treatment program can also be combined with dispersant addition in the dilution make-up feed water into a PSC. Preferred dispersants are low molecular weight anionic polymers.

11 Claims, No Drawings

PROCESSING AIDS TO IMPROVE THE BITUMEN RECOVERY AND FROTH QUALITY IN OIL SANDS EXTRACTION PROCESSES

FIELD OF THE INVENTION

This invention relates generally to bitumen extraction from oil sands. More specifically, the invention relates to methods of enhancing bitumen recovery and improving froth quality by reducing mineral content in mining oil sands extraction processes. The invention has particular relevance to using polymeric cationic or amphoteric coagulants and/or polymeric dispersants in such processes.

BACKGROUND OF THE INVENTION

It is estimated that at least 1.7 trillion barrels of heavy crude oil (sometimes referred to as bitumen) exists in the oil sands of northern Alberta, Canada. Oil sands are naturally occurring mixtures of sand or clay, water, and an extremely dense and viscous form of petroleum called bitumen. The bitumen extracted from oil sands is viscous, solid, or semisolid in form and is difficult to transport because it does not easily flow at temperatures normally encountered in an oil pipeline. Despite such transport difficulties and costs to process into gasoline, diesel fuel, and other products, oil sands are being mined on a vast scale to extract the bitumen, which may be converted into synthetic oil or refined directly into petroleum products.

Considerable amounts of this resource are mined by truck and shovel operations. Constituents of the mined material include bitumen, sand, clay, and water. A common method to initiate bitumen liberation from the sand grains is hydrotransport, where the crushed ore is mixed with hot water to create a slurry that is pumped by pipeline to a bitumen extraction plant. Due to the high shear and mixing imparted on the slurry in the pipeline, as well as aeration by means of either turbulent mixing or air injection, the oil sands become conditioned. This conditioning causes the bitumen to recede from the coarse solids and become aerated. A primary separation cell (PSC) is used to separate the coarse solids from the aerated bitumen.

The high shear of hydrotransport, along with addition of caustic when necessary to enhance bitumen recovery, causes the fines (defined as solid particles less that 44 micrometers in diameter) to become dispersed. While such dispersion of fines assists with bitumen recovery, it also causes other problems, one of which is a portion of the fines and clays (solids less than 2 micrometers) reporting to the bitumen froth layer. To reduce the mass of solids reporting to the bitumen froth, the bitumen droplets rise through a quiescent layer of water, termed the underwash water, just prior to forming the froth layer. The quiescent layer is achieved by introducing water directly below the formed bitumen froth layer (e.g., U.S. Pat. No. 3,847,789). The underwash layer enables some of the solids that have floated up with the bitumen to be washed back down into the middlings layer. Processing ores that contain high fines have historically led to poor froth quality as more solids are carried into the froth thus impacting secondary bitumen extraction by potentially plugging up the froth treatment equipment and causing the process to shut down and/or increasing the load on downstream froth treatment unit operations.

U.S. Patent Application Publication No. 2005/0194292 discloses a method to improve bitumen recovery from oil sands by adding a processing aid capable of sequestering cations. The bitumen is contacted with the processing aid before primary separation of the bitumen from the mineral matter. This patent application discloses dosing the processing aid prior to primary separation of the bitumen from the mineral solids.

PCT Patent Application WO 2009/089570 discloses a two-polymer system that floats aggregated mineral matter. The first polymer is hydrophilic and intended to minimize hetero-coagulation between two different types of particulate matter and/or liquid droplets. The second polymer is hydrophobic and absorbs preferentially to either the solids or the liquid matter to induce hydrophobic aggregation.

Chemical programs known in the prior art propose chemical addition at the ore preparation or hydrotransport stages of the process and are generally not cost-effective due to the large dosages that would be necessary to impart any improvement on bitumen recovery or froth quality. As a result, oil sands producers currently do not use specialty chemicals to enhance bitumen recovery or improve froth quality. There thus exists an industrial need for targeted application of specialty chemicals to improve bitumen recovery and enhance froth quality from oil sands extraction processes. A particular benefit of such targeted applications is that the specialty chemicals will not be consumed by coarse sand particles, and the dosage of the chemicals can be reduced to make them economically feasible.

BRIEF SUMMARY OF THE INVENTION

This invention accordingly provides targeted application of specialty chemicals at locations in the bitumen recovery process where the chemicals will not be consumed by coarse sand particles and at reduced dosages to make their use more economically feasible. In an aspect, the invention provides a method of improving froth quality and bitumen recovery from an oil sands slurry. In alternative embodiments, the method comprises a one component or a two component system. In an embodiment, the method includes introducing the oil sands slurry into a primary separation cell (herein sometimes referred to as "PSC") and contacting the oil sands slurry with underwash water comprising one or more of the coagulants herein described. In this one component system, as the froth rises through the underwash water, the coagulant(s) aid in reducing the amount of solids that report into the froth layer. The method further includes allowing the oil sands slurry to separate into a froth layer and a middlings layer, where the froth layer comprises a lower mineral solids content than would be present without the addition of coagulant in the underwash water.

In another embodiment, the method further comprises introducing a dispersant as herein described into the dilution make-up water of the PSC. In a typical application of the one component system, the level of bitumen recovery is acceptable and the froth contains high mineral levels. Benefits of the two component system are typically observed in cases where it desired to improve bitumen recovery and froth quality.

It is an advantage of the invention to provide a method of bitumen recovery from oil sands that efficiently utilizes specialty chemicals to aid in separating mineral solids from bitumen and reduces the mineral content reporting to the froth.

It is another advantage of the invention to provide a method of bitumen recovery that allows for increased particle-particle repulsion and consequently, higher particle surface area in the extraction process.

An additional advantage of the invention is to improve the efficiency of existing underwash water without the need for any process changes or supplementary equipment.

It is a further advantage of the invention to allow for a reduction in the use of caustic in the process which in turn will help downstream emulsion breaking.

It is yet another advantage of the invention is to reduce suspended fines and clays in the middlings layer which in turn reduces the amount of solids carried up into the froth layer in primary and secondary flotation steps.

Another advantage of invention is to provide a method of adding coagulant to an oil sands extraction process that may allow for a reduction in the underwash water temperature with a concomitant reduction in energy costs.

An additional advantage of the invention is to provide a method of improving an oil sands extraction process that may allow for a reduction in caustic use that in turn may assist to make downstream froth processing more efficient.

A further advantage of the invention is to provide an option of using a one component or two component system for enhancing bitumen recovery and improving froth quality that does not require the use of any additional equipment.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

DETAILED DESCRIPTION OF THE INVENTION

In an embodiment of the invention, a coagulant is added to the froth underwash water entering a PSC. Addition of the coagulant into the froth underwash water will allow for a portion of the fines and clays carried up into the froth layer to be coagulated and rejected from the froth, improving its quality. A coagulant added to the underwash water will generally cause the fines and clays carried up with the bitumen to coagulate and fall away from the bitumen froth rejecting them to the middlings and improving its quality. Laboratory froth underwash simulation results have shown that implementation of the present invention significantly reduces the solids content in the froth and also reduces that water content in the froth. For example, addition of 37 ppm to 48 ppm (on an actives and total froth volume basis) of coagulant shows more than a 15% decrease in solids content as well as a significant reduction in water content in the froth (see examples for details). In a preferred method of the invention, the coagulant is fed to the PSC with the underwash feed water, for example, by injection pump. Any suitable injection pump or other method of introducing the coagulant to the underwash may be used. It can be fed at room temperature, however the underwash feed water is typically ca. 80° C. but generally ranges from about 20° C. to about 90° C.

Preferred classes of polymers for use as coagulants in the method of the invention include homopolymers, copolymers, and terpolymers having charge densities from about 5% to 95% or from 95% to 5%. In an embodiment, the charge density is more than about 50% cationic in character. In another embodiment, the charge density is about three times more cationic in character than anionic when using a copolymer. These polymers may be cationic or amphoteric. In various embodiments, the polymers are solution polymers, dispersion polymers, latex polymers, or other suitable polymer. With respect to the conditions and medium for polymerization, they are not particularly limited and may conveniently be selected depending on the polymerization technique employed. The polymers may be linear, branched, or crosslinked and have any suitable architecture, such as comb, star, dendrimer, etc. It should be appreciated that the particular polymerization method or polymer architecture is not critical for the method of the invention and that any suitable method or architecture is desirable. Preferred polymers typically have a weight average molecular weight from about 50,000 Da to about 10 million Da, with about 500,000 Da to about 1 million Da being more preferred. The coagulants of the invention may be introduced into the PSC at a dosage range of about 1 ppm to about 500 ppm actives based on the mass of the ore feed (i.e., total dry ore mass). Preferred dosages would be from about 1 ppm to 100 ppm, or from about 1 ppm to about 20 ppm.

The coagulants of the invention are polymers that preferably comprise one or more of the following monomers: diallyldimethyl ammonium chloride (DADMAC), methacrylamidopropyltrimethyl ammonium chloride (MAPTAC), epichlorohydrin-dimethylamine (EPI-DMA), EPI-DMA crosslinked with ammonia or hexamethylene diamine, ethylene dichloride (EDC)-ammonia, acrylic acid (AA), methacrylic acid, acrylamide (AcAm), methacrylamide, substituted acrylamides with amide portion containing a $C_1$-$C_6$ group, triethylamine (TEA), dimethylaminoethylacrylate methyl chloride (DMAEA-MCQ), dimethylaminoethylmethacrylate methyl chloride (DMAEM-MCQ), dimethylaminoethylacrylate methyl sulfate (DMAEA-MSQ), dimethylaminoethylacrylate benzyl chloride (DMAEA-BCQ), (hydroxyethyl)methacrylate, (HEMA), and any combination of the foregoing. In various embodiments, the coagulant of the invention may be a homopolymer comprising any of the foregoing monomers, a copolymer comprising any combination of the foregoing monomers, a terpolymer comprising any combination of the foregoing monomers, and any combination thereof.

Particular examples of the coagulants of the invention include, but are not limited to, cationic amines such as poly (DADMAC) with a weight average molecular weight range of about 100,000 Da to about 1,000,000 Da; EPI-DMA copolymer of weight average molecular weight 500,000 Da; EPI-DMA crosslinked with either ammonia or HMDA polymer of approximate weight average molecular weight 200,000 Da; DADMAC-AcAm co-polymer with between about 20 to about 80% mole charge and weight average molecular weight of about 1 million to about 2 million Da; EDC-ammonia polymer; DADMAC-AA co-polymer with about 60 to about 95% DADMAC and an approximate weight average molecular weight of about 200,000 to about 500,000 million Da; poly(TEA) methyl chloride quat; DMAEA.MCQ-AA co-polymer with about 50 to about 90% DMAEA.MCQ and an approximate weight average molecular weight of 1 million Da; terpolymers such as DADMAC-AcAm-AA with about 25/50/25% mole ratios and weight average molecular weight approximately 1 million; MAPTAC-AcAm-AA with about 40/50/10% mole ratios and weight average molecular weight approximately 1 million Da; and any combination of the foregoing. Considering cationic flocculants for use as coagulants of the invention, specific examples include, but are not limited to, about 5 to about 80% mol of DMAEA.MCQ-AcAm, DMAEA.MSQ-AcAm, or DMAEA.BCQ-AcAm copolymer class of approximate weight average molecular weight of about 10 million Da.

In an embodiment, a dispersant is added to the dilution make-up water or to the ore feed. It is thought that addition of a dispersant will allow for increased particle-particle repulsion and consequently, higher particle surface area in the extraction process. This increased dispersion and resultant reduced slurry viscosity generally corresponds to increased bitumen flotation. Additionally, a dispersant added at this application point may allow for a reduction in the use of caustic in the process which in turn will help downstream emulsion breaking. The dispersant is typically added with the dilution make-up water fed into the PSC. This application point allows for sufficient residence time in the PSC as well as reduces the possibility of chemical loss to the coarser mineral solids. The dispersants of the invention may be introduced into the dilution make-up water or to the ore feed at a dosage range of about 1 ppm to about 500 ppm actives based on the mass of the ore feed. Preferred dosages would be from about 1 ppm to 50 ppm, or from about 1 ppm to about 20 ppm.

Suitable dispersants for use in the method of the invention include certain polymers having a weight average molecular weight in the range from about 1,000 Da to about 100,000 Da, with about 3,000 Da to about 30,000 Da being preferred. Examples of suitable classes of polymers for use as the dispersants of the invention are polyacrylic acid; polymethacrylic acid; polyacrylamide; polymethacrylamide and derivatives thereof; polyaspartic acid; polystyrene sulfonate; vinyl sulfonate copolymerized with acrylic acid; acrylamide copolymerized with sulfonate or ethylene oxide groups; polymers of maleic anhydride; methacrylic and maleic acid copolymers; acrylamide and acrylic acid copolymers; acrylic acid/polyethylene glycol copolymers; poly(2-acrylamido-2-methyl-1-propanesulfonic acid) (polyAMPS); polymers comprising AMPS; and any combination thereof In an embodiment, siliceous materials may also be used as a dispersant. For example, colloidal silica with a particle size of about 2 nm to about 90 nm, preferably less than 20 nm, may also be used for the purpose of dispersion. In another example, colloidal silica particles having an average diameter from about 1 to about 250 nanometers may be used. In a further example, any suitable siliceous material may be used, such as that disclosed in U.S. patent application Ser. Nos. 09/604,335; 10/827,214; 12/628,472; and 12/209,790.

Particular examples of polymers for use as the dispersant of the invention include acrylic acid polymer with a weight average molecular weight of about 2,000 Da to about 5,000 Da; acrylic acid polymer with sodium parastyrene sulfonate with a weight average molecular weight of about 10,000 Da to about 30,000 Da; acrylic acid polymer with sodium AMPS (60/40 wt/wt) with a weight average molecular weight of about 15,000 Da to about 25,000 Da; polymethacrylate with a weight average molecular weight of about 13,000 Da to about 15,000 Da; sulfomethylated acrylic acid-acrylamide copolymer with a weight average molecular weight of about 25,000 Da to about 30,000 Da; and any combination thereof.

In another embodiment, this invention comprises the use of a coagulant added to the froth underwash water combined with a dispersant added to the dilution make-up water or the ore feed entering a primary separation cell (PSC) in oil sands mining bitumen flotation processes. Dilution recycle water is added into the PSC along with the ore slurry. This dilution water contains suspended clays. Coagulants could also be added to the recycle water to reduce the concentration of suspended clays. Coagulant addition may also be used in secondary flotation processes for clays and fines rejection. Additionally, the same coagulant chemistry can be used later in the froth treatment process (e.g., hydrocyclone separators and centrifuges) to enable rejection of the solids to the tailings ponds.

In a further embodiment, the coagulant and dispersant may be used together as a two-component system. For example, a coagulant may be needed if higher than preferred amounts of solids are reporting to the froth layer. A dispersant may be used if bitumen recovery is lower than preferred. Dispersant addition may cause more solids to report to the froth layer in which case a coagulant can be added to the underwash water to assist in rejecting a portion of the solids to the middlings layer.

The foregoing may be better understood by reference to the following examples, which are intended for illustrative purposes and are not intended to limit the scope of the invention.

Example 1

This example illustrates solids reduction in primary bitumen froth by coagulant addition in the underwash water using Test Method A.

An oil sands ore slurry obtained from a Canadian source was prepared using a Denver cell with 500 g of homogenized oil sands ore and 1.2 L of process water. The pH of the prepared slurry was adjusted to pH 9 and slurry formation was carried out for 20 minutes at 55° C. The impeller was situated in the slurry in a manner that the liberated bitumen was continually mixed into the slurry, which ensured that stable froth was not formed before the underwash step was simulated.

Stock solutions of poly(diallyldimethyl ammonium chloride) having a molecular weight of 200,000-1,000,000 were prepared in process water. A blank stock solution consisted solely of process water. After 20 minutes of slurry formation in the Denver cell, agitation was ceased and 20 g of the stock solution was sprayed on top of the slurry prior to froth flotation. A blank was also run using process water following the same underwash testing procedure. The underwash solution was sprayed into the slurry using a spray bottle, and was completely dosed within 30 seconds. Quickly spraying the underwash solution ensured that the chemical was present in a quiescent layer through which the rising bitumen droplets would pass through to form the froth. The resulting froth was collected after standing at 55° C. in the Denver cell for 10 minutes, weighed and analyzed by Dean-Stark analysis for froth quality.

The chemical dosage was back calculated based on the amount of froth collected for Dean-Stark analysis. In the following equation, W is the weight of froth collected in grams, X is the weight of coagulant solution sprayed, Y is the wt % (g/g) concentration of the coagulant solution, and Z is the dosage in ppm (on a coagulant solution weight to froth weight basis).

$$(XY/W)*10^4=Z$$

For example, if 50 g of froth was collected and 20 g of a 0.08 wt % coagulant solution was sprayed onto the slurry, the dosage was $[(0.08\text{ wt }\%)*(20\text{ g})]*10^4/50\text{ g}=320$ ppm.

Table 1 shows solids content in primary bitumen froth comparing increasing dosages of coagulant to the blank in underwash simulation testing. The ore sample consisted of 6.9 wt % bitumen, 87.5 wt % solids and 5.6 wt % water.

TABLE 1

| Additive | Dose (ppm) | Froth (g) | Solids in Froth (%) |
|---|---|---|---|
| Blank | — | 44.88 | 19.0 |
| Blank | — | 44.03 | 21.1 |
| Coagulant | 335 | 47.78 | 15.8 |
| Coagulant | 436 | 36.67 | 12.7 |
| Coagulant | 652 | 49.09 | 13.0 |

Example 2

This example illustrates solids reduction in primary bitumen froth by coagulant addition in the underwash water using Test Method B.

Bitumen froth was generated in a Denver cell at 55° C. using 700 g of homogenized oil sands ore and recycle water obtained from a Canadian source (55° C., 1.15 L) adjusted to pH 9.5. The slurry was mixed for 20 minutes at an impeller speed of 800 RPM. The slurry was also treated with an acrylic acid polymer (20 ppm wt/wt dose based on ore). Air was added into the oil sands slurry for the final minute to assist in froth generation. The froth was collected in 10-15 g portions and floated on top of process water. A dilute solution of coagulant (0.04 wt %, ca. 10 g) was sprayed on top of the froth using a spray bottle. Runs that consisted of spraying solely process water were also carried out. The solution was allowed to diffuse through the froth for 20 minutes and the froth was collected and analyzed for bitumen and solids content by Dean-Stark extraction. The froth collected directly from the Denver cell, without any underwash treatment, was found to have 22.4% bitumen and 18.4% solids.

A reduction in the solids content in the primary froth was seen. In this instance, the average of three blank runs (Table 2) resulted in 16.2% solids content in the froth and the average of 2 runs using the coagulant (in 265 ppm or 368 ppm doses, Table 3) resulted in 13.9% solids content in the froth. This represents a 14.2% reduction in the solids content in the froth.

TABLE 2

| Recycle $H_2O$ (g) | Froth (g) | Bitumen in Froth (%) | Solids in Froth (%) |
|---|---|---|---|
| 10.24 | 16.39 | 33.5 | 18.1 |
| 10.34 | 12.94 | 33.5 | 16.3 |
| 10.29 | 13.06 | 33.7 | 14.1 |
| Avg. | | | 16.2 |

TABLE 3

| Coagulant (ppm) | Froth (g) | Bitumen in Froth (%) | Solids in Froth (%) |
|---|---|---|---|
| 368 | 10.19 | 37.4 | 13.2 |
| 265 | 12.58 | 37.5 | 14.5 |
| Avg. | | | 13.9 |

Example 3

This example illustrates trial results of the coagulant dosed in the underwash feed water of a primary separation cell (PSC). Both the blank and chemical treatment trials had an ore feed rate of 5,000 ton/hr with a pH of 7.7 and an underwash flow rate of 650 $m^3$/hr.

The ore feed for the blank trial contained 8.0% bitumen and 63.0% solids. The primary froth coming off the PSC had 47.9% bitumen and 13.4% solids. The chemical treatment trial consisted of dosing the coagulant into the underwash feed water of the PSC at a dosage of 57 ppm based on the ore feed (w/w polymer/ore: polymer feed of 570 lbs/hr). The ore feed for this trial had 7.1% bitumen and 62.6% solids. The primary froth coming off the PSC contained 47.3% bitumen and 9.6% solids. This is a 28% decrease in solids content reporting to the froth and occurred despite the fact that the ore feed for the coagulant trial was of poorer quality than the ore for the blank trial. Notably, the bitumen content reporting to the PSC underflow was the same for both the blank (0.9%) and chemical treatment (1.0%) trials, providing evidence that the chemical treatment does not hinder bitumen recovery. All bitumen and solids data were obtained by Dean-Stark analysis.

That addition of cationic coagulant did not hinder bitumen reporting to the froth was unexpected. The fact that bitumen losses to the underflow did not occur was attributed to the fact that coagulant was added with the underwash stream rather than to the ore prior to bitumen liberation. In previous batch extraction unit experiments, addition of the coagulant to the ore prior to bitumen liberation resulted in an up to 15% reduction in primary bitumen recovery relative to the blank run. Thus, the observation that targeted addition of coagulant to the underwash water did not hinder bitumen reporting to the froth was surprising and unexpected.

Example 4

This example is similar to example 3 and illustrates trial results of the coagulant dosed in the underwash feed water of a PSC. Both the blank and chemical treatment trials had an ore feed rate of 6,700 ton/hr with a pH of 9.2 and an underwash flow rate of 600 $m^3$/hr.

The ore feed for the blank trial contained 8.6% bitumen and 60.4% solids with a fines feed rate of 862 ton/hr. The primary froth for this trial contained 55.5% bitumen and 10.5% solids. The ore feed for the chemical treatment trial had 7.3% bitumen and 63.2% solids and a fines feed rate of 1,037 ton/hr. The coagulant was dosed in the underwash feed water at 59 ppm based on the ore feed (w/w polymer/ore: polymer feed 590 lbs/hr). Despite the poorer quality feed and a higher fines feed rate for the chemical addition trial, a reduction in solids content in the froth was observed, with 10.0% solids reporting to the froth and 53.8% bitumen. Again, the bitumen content reporting the PSC underflow was the same for both the blank and chemical treatment trials, providing evidence that the chemical treatment does not hinder bitumen recovery.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated.

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the invention encompasses any and all possible combinations of some or all of the various embodiments described herein. Any and all patents, patent applications, scientific papers, and other references cited in this application, as well as any references cited therein, are hereby incorporated by reference in their entirety. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

The claimed invention is:

1. A method to improve froth quality and bitumen recovery from an oil sands slurry, the oil sands slurry comprising bitumen, mineral solids, and water, the method comprising:

(a) introducing the oil sands slurry into a primary separation cell;

(b) contacting an effective amount of a dispersant with the oil sands slurry via adding the dispersant to an ore feed and/or adding the dispersant to a dilution make-up water;

(c) contacting an underwash water with the oil sands slurry, wherein the underwash water comprises an effective amount of a coagulant, wherein the coagulant comprises one or more polymers selected from the group consisting of: about 5 to about 80% mol of DMAEA.MCQ-AcAm, DMAEA.MSQ-AcAm, or DMAEA.BCQ-AcAm copolymer class of approximate weight average molecular weight of about 10 million Da; and (d) allowing the oil sands slurry to separate into a froth layer and a middlings layer, wherein the froth layer comprises a lower mineral solids content than would be present without the addition of coagulant in the underwash water;

wherein the coagulant and the dispersant are temporally positioned in the method so as to address the competing functions of the dispersant and the coagulant.

2. The method of claim 1, wherein the dispersant comprises a low molecular weight polymer having a weight average molecular weight in the range from about 1,000 Da to about 100,000 Da.

3. The method of claim 1, wherein the dispersant further comprises one or more polymers having a weight average molecular weight in the range from about 1,000 Da to about 100,000 Da.

4. The method of claim 1, wherein the dispersant further comprises one or more polymers having a weight average molecular weight in the range from about 3,000 Da to about 30,000 Da.

5. The method of claim 1, wherein the dispersant further comprises one or more polymers selected from the group consisting of: polyacrylic acid; polymethacrylic acid; polyacrylamide; polymethacrylamide and derivatives thereof; polyaspartic acid; polystyrene sulfonate; vinyl sulfonate copolymerized with acrylic acid; acrylamide copolymerized with sulfonate or ethylene oxide groups; polymers of maleic anhydride; methacrylic and maleic acid copolymers; acrylamide and acrylic acid copolymers; acrylic acid/polyethylene glycol copolymers; poly(2-acrylamido-2-methyl-1-propanesulfonic acid) (polyAMPS); polymers comprising AMPS; and any combination thereof.

6. The method of claim 1, wherein the dispersant further comprises one or more polymers selected from the group consisting of: acrylic acid polymer with a weight average molecular weight of about 2,000 Da to about 5,000 Da; acrylic acid polymer with sodium parastyrene sulfonate with a weight average average molecular weight of about 10,000 Da to about 30,000 Da; acrylic acid polymer with sodium AMPS (60/40 wt/wt) with a weight average molecular weight of about 15,000 Da to about 25,000 Da; polymethacrylate with a weight average molecular weight of about 13,000 Da to about 15,000 Da; sulfomethylated acrylic acid-acrylamide copolymer with a weight average molecular weight of about 25,000 Da to about 30,000 Da; and any combination thereof.

7. The method of claim 1, wherein the mineral solids are selected from the group consisting of: coarse solids, fines, clays, and any combination thereof.

8. The method of claim 1, wherein the method provides a 14.2% reduction in the mineral solids content of the froth layer compared to a method without any underwash treatment.

9. The method of claim 1, wherein the method provides a 28% decrease in mineral solids content reporting to the froth layer compared to a blank trial without coagulant treatment.

10. The method of claim 1, wherein the dispersant is an acrylic acid polymer dosed at 20 ppm wt/wt dose based on ore feed.

11. The method of claim 1, wherein the coagulant is dosed into the underwash feed water at a dosage of 57 ppm based on the ore feed.

* * * * *